US011011863B2

(12) United States Patent
Tsai et al.

(10) Patent No.: US 11,011,863 B2
(45) Date of Patent: May 18, 2021

(54) ELECTRICAL CONNECTOR

(71) Applicant: Advanced Connectek Inc., New Taipei (TW)

(72) Inventors: Yu-Lun Tsai, New Taipei (TW); Pin-Yuan Hou, New Taipei (TW); Hsu-Fen Wang, New Taipei (TW); Kang Qin Li, New Taipei (TW); Xi Wang, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 19 days.

(21) Appl. No.: 16/386,285

(22) Filed: Apr. 17, 2019

(65) Prior Publication Data

US 2019/0326698 A1 Oct. 24, 2019

(30) Foreign Application Priority Data

Apr. 20, 2018 (CN) ..... 201810357316.4

(51) Int. Cl.

| | |
|---|---|
| ***H01R 24/00*** | (2011.01) |
| ***H01R 13/405*** | (2006.01) |
| ***H01R 12/72*** | (2011.01) |
| ***H01R 13/6581*** | (2011.01) |

(52) U.S. Cl.

CPC ..... *H01R 13/405* (2013.01); *H01R 12/724* (2013.01); *H01R 13/6581* (2013.01)

(58) Field of Classification Search

CPC .. H01R 12/722; H01R 12/724; H01R 13/405; H01R 13/6581

USPC ..... 439/660, 676

See application file for complete search history.

(56) References Cited

U.S. PATENT DOCUMENTS

| | | | | |
|---|---|---|---|---|
| 9,634,409 | B2 * | 4/2017 | Tsai | H01R 13/6581 |
| 9,685,740 | B1 * | 6/2017 | Hsu | H05K 7/1401 |
| 9,742,098 | B2 * | 8/2017 | Zhao | H01R 13/6581 |
| 10,355,421 | B2 * | 7/2019 | Zhao | H01R 13/6594 |
| 2015/0079843 | A1 * | 3/2015 | Nakashima | H01R 13/6585 439/607.09 |

* cited by examiner

*Primary Examiner* — Khiem M Nguyen
(74) *Attorney, Agent, or Firm* — JCIPRNET

(57) ABSTRACT

An electrical connector including an insulating body, a plurality of terminals, and at least one grounding member is provided. The terminals and the grounding member are disposed in the insulating body. At least one grounding terminal among the terminals and the grounding member next to the grounding terminal form an integrally-molded structure. A portion of the grounding terminal and a portion of the grounding member are misaligned from each other along an arrangement direction of the terminals.

18 Claims, 10 Drawing Sheets

ELECTRICAL CONNECTOR

CROSS-REFERENCE TO RELATED APPLICATION

This application claims the priority benefit of China patent application serial no. 201810357316.4, filed on Apr. 20, 2018. The entirety of the above-mentioned patent application is hereby incorporated by reference herein and made a part of the specification.

BACKGROUND OF THE INVENTION

1. Field of the Invention

The invention relates to an electrical connector.

2. Description of Related Art

Universal serial buses (USBs) are commonly used by the public and the transmission specification of USB has evolved from USB 2.0 to USB 3.0 that exhibits a higher transmission speed. The appearance, structure, contacting manner of terminals, number of terminals, pitch between respective terminals, and pin assignment of respective terminals of the conventional USB Type-C electrical connector are completely different from the current USB electrical connector. The conventional USB Type-C receptacle connectors generally include a plurality of elastic terminals and a plurality of flat terminals disposed in an insulating body, and the insulating body is externally covered by a structure such as a metallic outer shell.

However, regardless of the structure, it is difficult to prevent damages to the terminals or the insulating body from mishandling or mistakenly inserting to other connectors by the user. When damaged, the receptacle connectors often need to be disassembled from the entire device, such as removing from the receptacle connector from the motherboard, for further replacement or repair to take place, which results in a complicated process and high maintenance cost.

Furthermore, in the existing USB Type-C electrical receptacle connector, after a plurality of insulating body parts embedded with terminals are first manufactured, the insulating body part, the grounding piece, and another insulating body part embedded with terminals are stacked and assembled together, and it may even be required to further perform a molding process on the above components. Such process is complicated and the terminals require different pressing molds. The process is complicated and requires high precision, so it is likely to have a higher defect rate, which thus affects the production efficiency and cost.

SUMMARY OF THE INVENTION

The invention provides an electrical connector having a simplified structure and configuration, and is capable of preventing improper operation.

An electrical connector of the invention includes an insulating body, a plurality of terminals, and at least one grounding member. The terminals and the grounding member are disposed in the insulating body. At least one grounding terminal among the terminals and the grounding member next to the grounding terminal form an integrally-molded structure. A portion of the grounding terminal and a portion of the grounding member are misaligned from each other along an arrangement direction of the terminals.

According to some embodiments, the integrally-molded structure has a first section, a second section, and a third section, the second section and the third section extend and bifurcated from the first section, the second section is a portion of the at least one grounding terminal, and the third section is a portion of the at least one grounding member.

According to some embodiments, the first section and the second section are located on a same plane, and the third section is located above the plane.

According to some embodiments, the integrally-molded structure further includes a fourth section, and the second section and the third section are respectively connected between the first section and the fourth section.

According to some embodiments, the fourth section and the second section are located on a same plane.

According to some embodiments, the integrally-molded structure has a bending part located between the first section and the third section, and a side surface of the insulating body has at least one protruding block pressed against the bending part.

According to some embodiments, the terminals are classified into a first terminal set and a second terminal set, the first terminal set is located on a first plane of the insulating body, the second terminal set is located on a second plane of the insulating body, and the first plane is parallel to and different from the second plane. The at least one grounding member and a grounding terminal of the first terminal set form the integrally-molded structure, or the at least one grounding member and a grounding terminal of the second terminal set form the integrally-molded structure.

In some embodiments, the portion of the at least one grounding member misaligned from the portion of the at least one grounding terminal is located on a third plane of the insulating body, the third plane is parallel to and different from the first plane and the second plane, and the third plane is located between the first plane and the second plane.

In some embodiments, an orthogonal projection of the grounding terminal of the first terminal set on the second plane is overlapped with the grounding terminal of the second terminal set, and an orthogonal projection of the at least one grounding member on the second plane is misaligned from and not overlapped with the grounding terminal of the second terminal set.

In some embodiments, the terminals are classified into a first terminal set and a second terminal set, the first terminal set and the second terminal set are located on different planes of the insulating body, each of the first terminal set and the second terminal set has a grounding terminal, and the grounding terminals are located at a same side of the insulating body and form the integrally-molded structure with the grounding member.

Based on the above, in the electrical connector according to the invention, at least one grounding terminal and the grounding member next to the grounding terminal form an integrally-molded structure, and along the arrangement direction of the terminals, a portion of the grounding terminal and a portion of the grounding member are misaligned from each other. In other words, the grounding terminal and the grounding member structure are integrally molded in the invention, so the manufacturing process may be effectively simplified. In other words, the grounding terminal and the grounding member may be manufactured by using a single mold set. Therefore, the manufacturing cost may be effectively reduced. Meanwhile, the portions where the grounding member and the grounding terminals are misaligned from each other are also the pressed portions when being connected with another electrical connector. Therefore, the pitch between terminals defined in relevant standards of the electrical connector is still met. Therefore, the electrical connector according to the embodiments of the invention exhibits desirable effects in design and manufacture under the premise that the required functional conditions are met.

To make the above features and advantages of the invention more comprehensible, embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
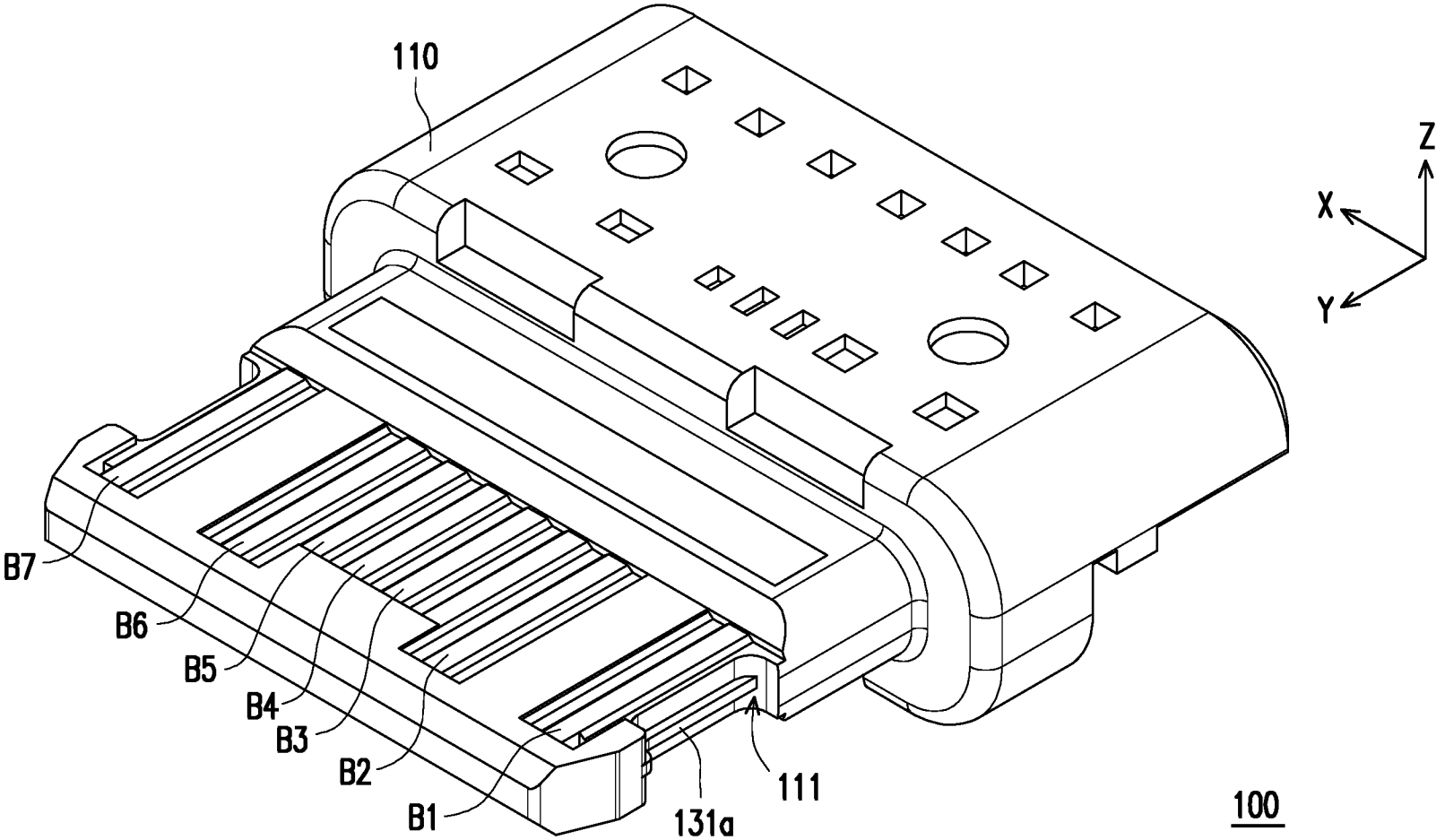
FIG. 1 is a schematic view of an electrical connector according to an embodiment of the invention.

Reference will now be made in detail to the present embodiments of the invention, examples of which are illustrated in the accompanying drawings. Wherever possible, the same reference numbers are used in the drawings and the description to refer to the same or like parts.

Figure 2:
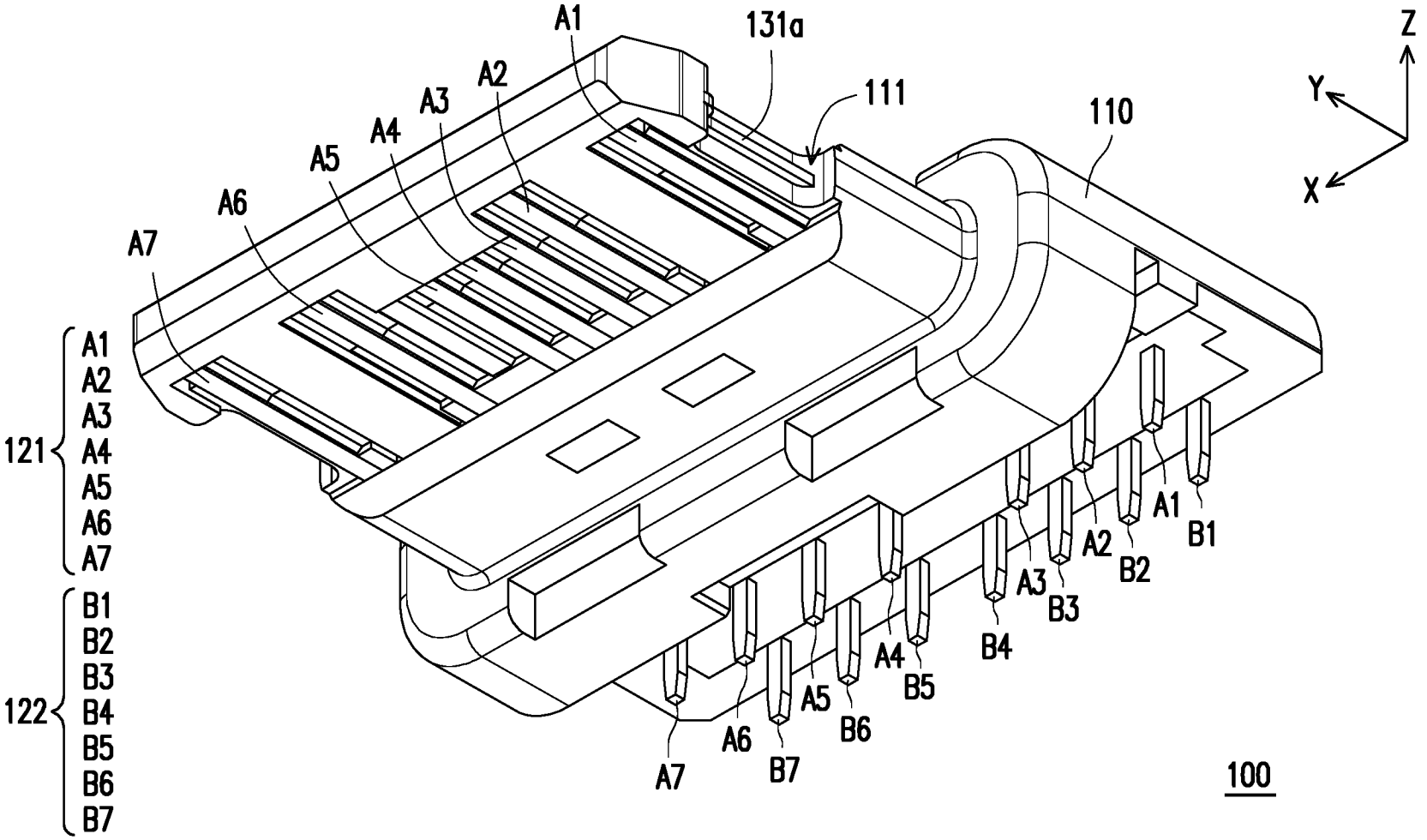
FIG. 2 is a schematic view of the electrical connector of FIG. 1 from another perspective.
Figure 3:
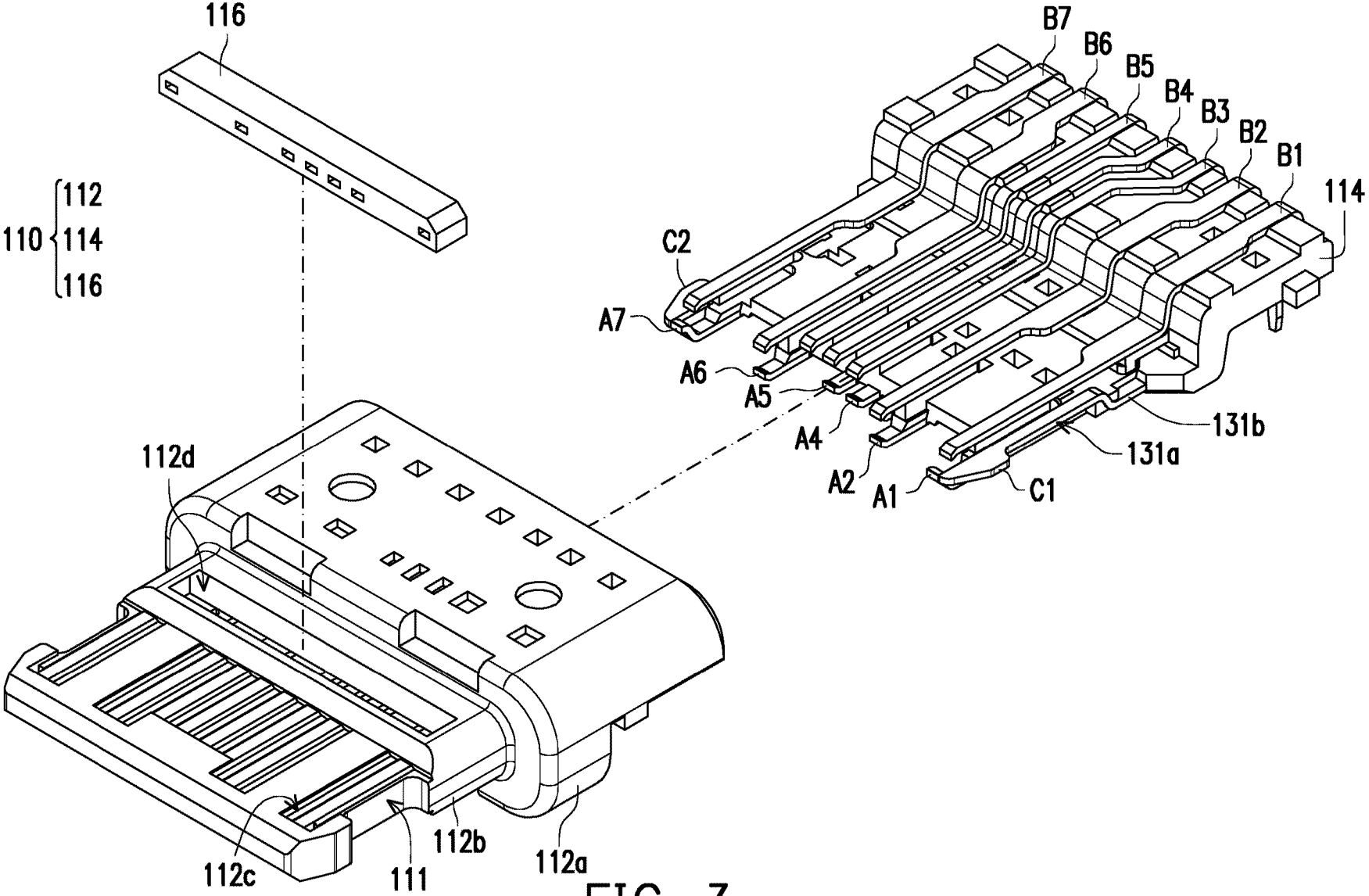
FIGS. 3 and 4 respectively illustrates exploded views of an electrical connector at different degrees.
Figure 4:
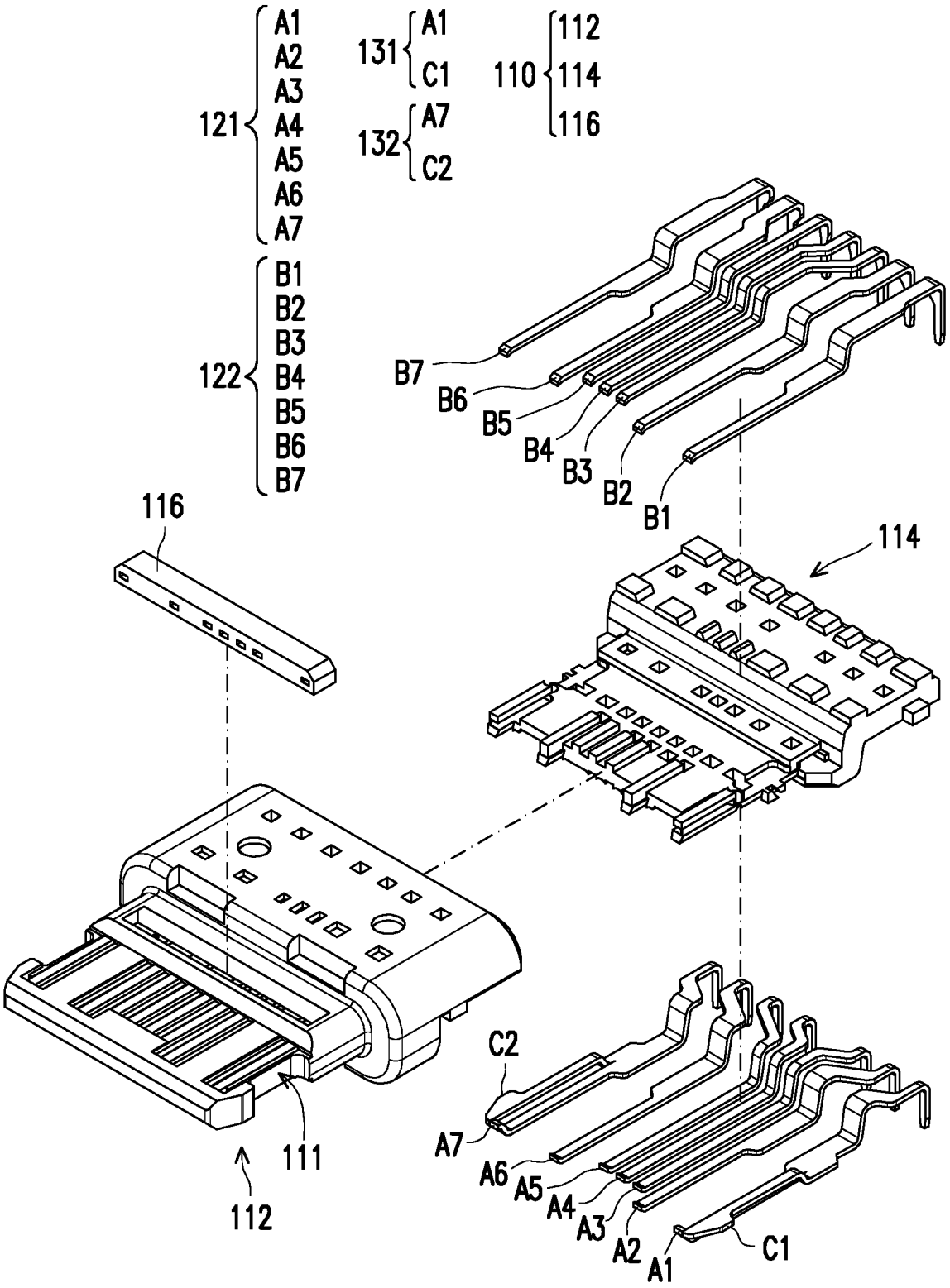

FIG. 1 is a schematic view of an electrical connector according to an embodiment of the invention. FIG. 2 is a schematic view of the electrical connector of FIG. 1 from another perspective. FIGS. 3 and 4 respectively illustrates exploded views of an electrical connector at different degrees. Here, a Cartesian coordinate system is provided for the ease of describing relevant components. Referring to FIGS. 1 to 4, in this embodiment, an electrical connector 100, such as a receptacle connector, includes an insulating body 110, a plurality of terminals Al to A7 and B1 to B7, and grounding members C1 and C2. The terminals A1 to A7 and B1 to B7 are disposed in the insulating body 110 by, for example, insert molding (but the invention is not limited thereto). In addition, among the terminals A1 to A7 and B1 to B7, the terminals A1 and A7 are respectively grounding terminals (GND), and are respectively next to the grounding members C1 and C2. It should be noted that, in the embodiment, the terminal A1 and the grounding member C1 form an integrally-molded structure 131, and the terminal A7 and the grounding member C2 form an integrally-molded structure 132.

Specifically, the insulating body 110 includes members 112, 114, and 116. The member 112 has a main body 112*a*, a tongue portion 112*b* extending from the main body 112*a*, and slots 112*c* and 112*d* disposed on the tongue portion 112*b*. In addition, a plurality of the slots 112*c* are respectively disposed on the upper and lower surfaces of the tongue portion 112*b*, but only one slot 112*c* is marked herein as an example. Regarding the assembling process, after the terminals A1 to A7 and B1 to B7 are first disposed on the upper and lower surfaces of the member 114, and the grounding members C1 and C2 are disposed on opposite lateral side surfaces of the member 114, and then the terminals A1 to A7 and B1 to B7 and the member 114 are embedded into the member 112. The terminals B1 to B7 further penetrate through the member 116, and the member 116 is fixed to the slot 112*d* on the tongue portion 112*b*. Portions of the terminals A1 to A7 and B1 to B7 that have been assembled are respectively exposed from the insulating body 110 at the slot 112*c* in order to facilitate electrical docking with another electrical connector (not shown). Meanwhile, portions of the terminals A1 to A7 and B1 to B7 that are away from the tongue portion 112*b* and penetrate through the lower surface of the main body 112*a* are suitable to be disposed and soldered to a through hole (not shown) of a circuit board and form an electrical connection, so as to dispose the receptacle connector on the circuit board. It should be noted that the above description is only one of the assembly processes, and the embodiment does not intend to limit the assembling process of the component.

In this embodiment, the terminals A1 to A7 and B1 to B7 are further classified into a first terminal set 121 (composed of the terminals A1 to A7) and a second terminal set 122 (composed of the terminals B1 to B7). The terminals A1 to A7 and the terminals B1 to B7 along the Z axis respectively belong to different planes of the insulating body 110 and correspond to each other by a separation by the member 114. In addition, the terminals A1, A7, B1, and B7 are grounding terminals.

Figure 5:
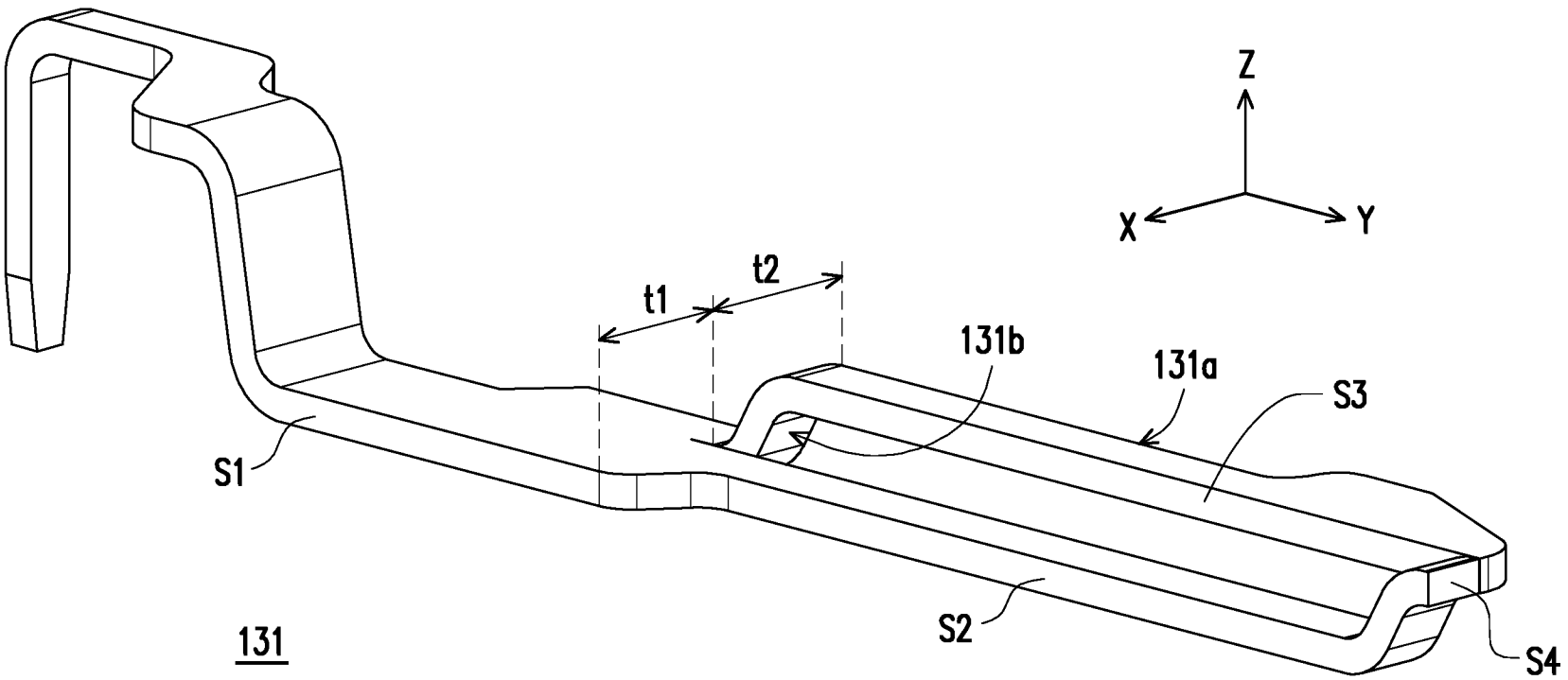
FIG. 5 is a structural schematic view of a grounding terminal and a grounding member.
Figure 6B:
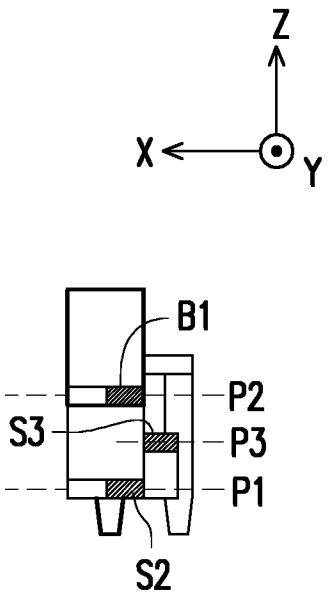
FIG. 6B is a cross-sectional view taken along line A-A' of FIG. 6A.
Figure 6A:
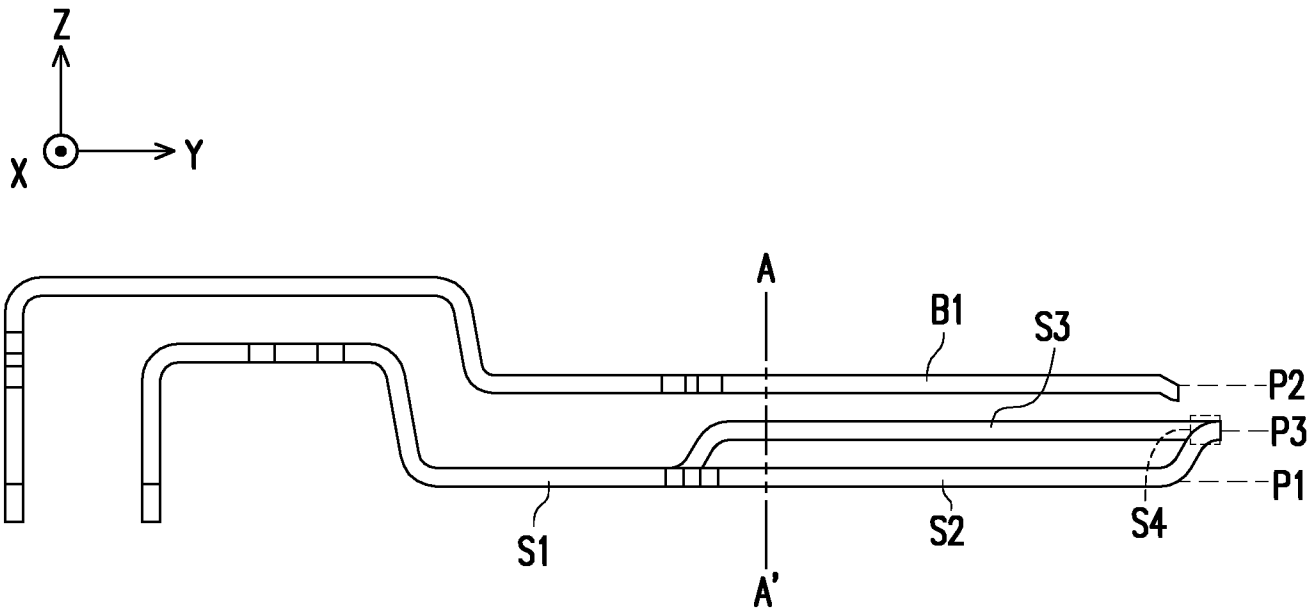
FIG. 6A is a side view of an integrally-molded structure and the corresponding terminal of FIG. 5.

FIG. 5 is a structural schematic view of a grounding terminal and a grounding member. FIG. 6 is a side view of an integrally-molded structure and the corresponding terminal of FIG. 5. FIG. 6B is a cross-sectional view taken along line A-A' of FIG. 6A. Referring to FIGS. 5, 6A, and 6B, the integrally-molded structure 131 formed by the terminal A1 and the grounding member C1 is described herein as an example. As the integrally-molded structure 132 formed by the terminal A7 and the grounding member C2 also exhibits the same characteristics, the same description will not be repeated. In this embodiment, the integrally-molded structure 131 essentially extends along the Y-axis, and is divided into a first section S1, a second section S2, and a third section S3. The second section S2 and the third section S3 extend from the structure of the first section S1 and form a bifurcation. As shown in the drawings, a width t1 of the second section S2 at the bifurcation is equal to a width t2 of the third section S3 at the bifurcation.

Moreover, the first section S1 and the second section S2 are located on a first plane P1, and the third section S3 is located on a third plane P3 above the first plane P1. The terminal B1 of the second terminal set 122 corresponds to the terminal A1 of the first terminal set 121, and is located on a second plane P2. Here, the first plane P1, the second plane P2, and the third plane P3 are parallel with one another (i.e., all parallel to the X-Y plane), and the second plane P2 is located between the first plane P1 and the third plane P3. In addition, the second section S2 may be considered as a portion of the grounding terminal (terminal A1), and the third section S3 may be considered as a portion of the grounding member C1.

Based on the above, the corresponding relationship among the terminals A1 and B1 and the grounding member C1 may be understood. As shown in FIG. 6B, with the first plane P1 at which the second section S2 is located as the reference, the orthogonal projection of the terminal B1 of the second terminal set 122 on the first plane P1 is overlapped with the second section S2, and the orthogonal projection of the third section S3 on the first plane P1 is misaligned from and not overlapped with the second section S2. In other words, the terminal B1 essentially faces the terminal A1, and the grounding member C1 is misaligned from the terminals A1 and B1, and the direction in which the grounding member C1 is misaligned from the terminals A1 and B1 is the arrangement direction of the terminals of the first terminal set 121 or the second terminal set 122 (i.e., the X-axis direction).

It should be noted that, even though the terminal A1 of the first terminal set 121 and the grounding member C1 are shown to form the integrally-molded structure 131 in the embodiment, the invention is not limited thereto. In another embodiment not shown herein, the grounding member C1 may also form an integrally-molded structure with the terminal B1 of the second terminal set 122.

In addition, the integrally-molded structure 131 further includes a fourth section S4. The second section S2 and the third section S3 are respectively connected between the first section S1 and the fourth section S4, and the fourth section S4 and the third section S3 are located on the third plane P3. In other words, in the positive Y-axis direction, the terminal A1 is first bifurcate into the second section S2 and the third section S3, and the third section S3 is further bent along the Z-axis to ascend with respect to the second section S2. Then, the second section S2 extends and ascends from the first plane P1 to the third plane P3 to converge with the third section S3 into one to form the fourth section S4. In this way, the structural strength of the terminal A1 is higher. In other words, during the molding and combining process with the insulating body 110, the first section S1 and the fourth section S4 are encapsulated in the insulating body 110, with only a portion of the second section S2 and a portion of the third section S3 are exposed by the slot 112*c*, as shown in FIGS. 1 and 2. In this way, the circumstance where the second section S2 or the third section S3 projects out of the insulating body 110 is prevented.

Figure 7:
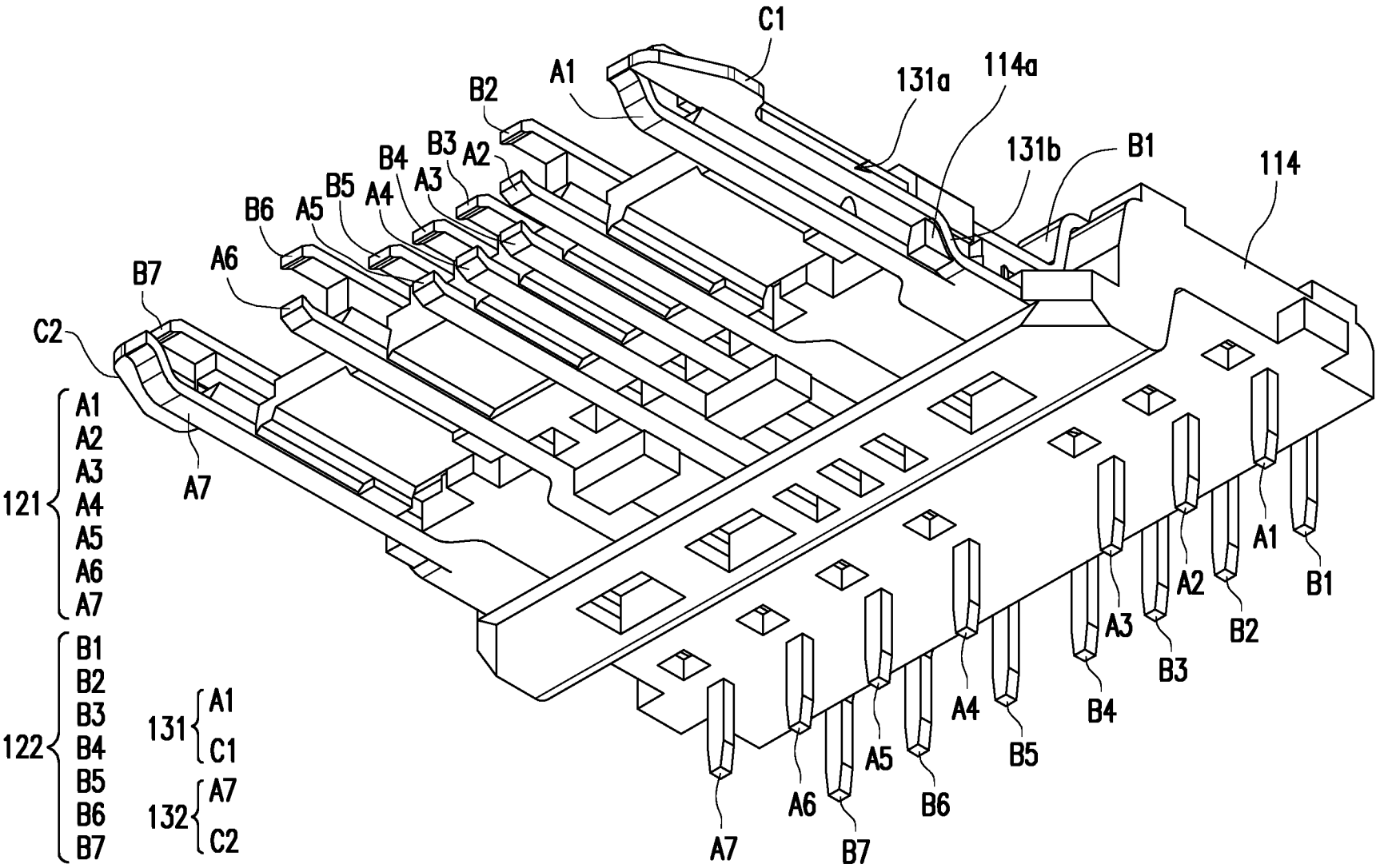
FIGS. 7 and 8 respectively illustrate a partial schematic view of an electrical connector.
Figure 8:
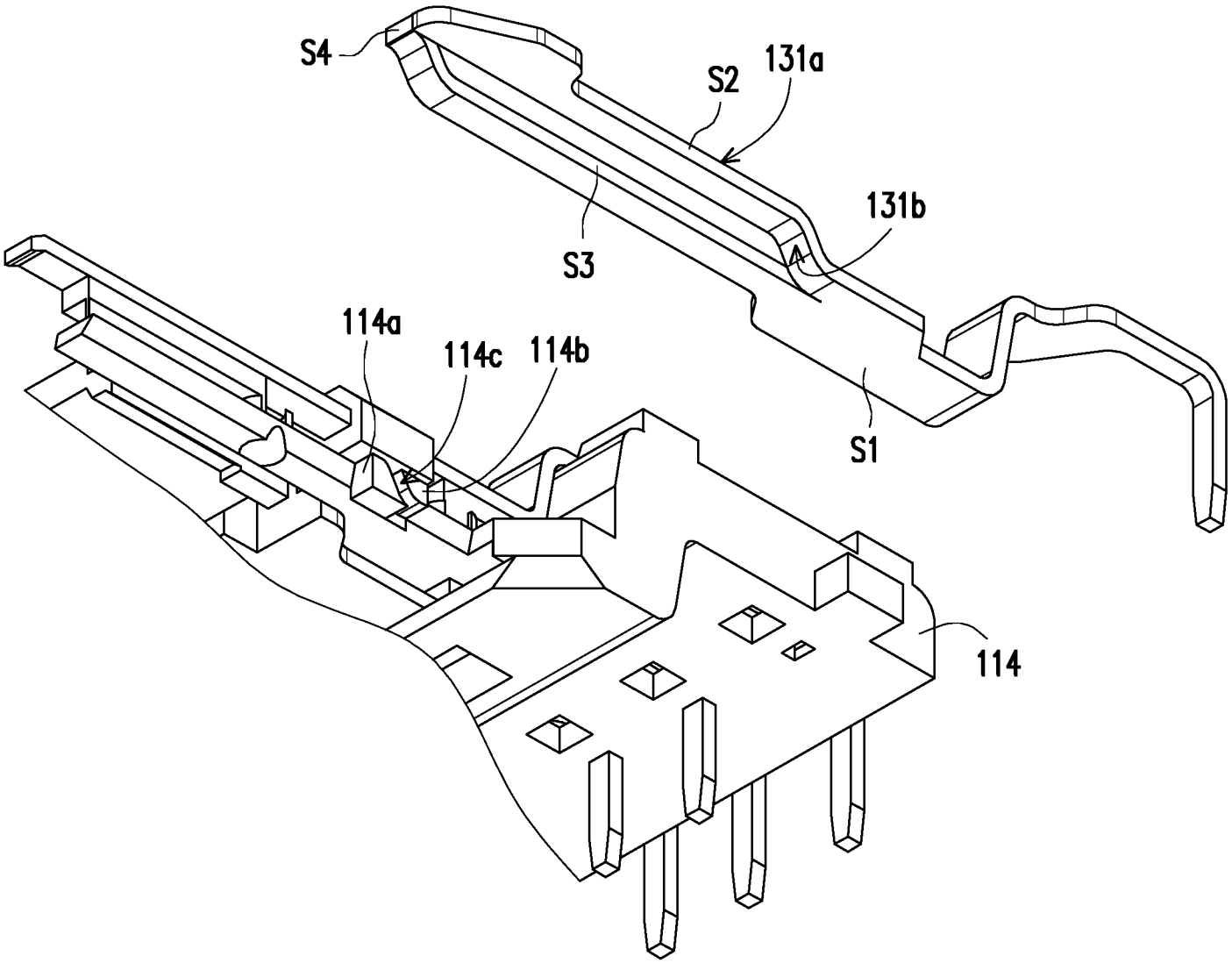

FIGS. 7 and 8 respectively illustrate a partial schematic view of an electrical connector. Referring to FIGS. 7 and 8, in this embodiment, the integrally-molded structure 131 formed by the terminal A1 and the grounding member C1 has a bending part 131*b* located between the first section S1 and the third section S3, whereas protruding blocks 114*a* and 114*b* and a channel 114*c* between the protruding blocks 114*a* and 114*b* are provided on a side surface of the member 114 of the insulating body 110. When the integrally-molded structure 131 is combined with the member 114, the bending part 131*b* essentially passes through the channel 114*c* and is pressed between the protruding blocks 114*a* and 114*b*.

In addition, referring to FIGS. 1 to 4, the integrally-molded structure 131 further includes a exposed part 131*a* on the third section S3. The exposed part 131*a* is exposed from a side recess 111 of the insulating body 110. Therefore, when the electrical connector 100 is mated with another electrical connector (e.g., an electrical plug connector, not shown herein), a grounding side latch of the electrical plug connector may be buckled to the side recess 111 and structurally contact the exposed part 131*a* to provide proper mechanical and electrical mating of the plug connector to the electrical receptacle connector, so as to make ground connections and thus to provide a ground path during insertion of the electrical plug connector to the electrical receptacle connector.

Figure 9:
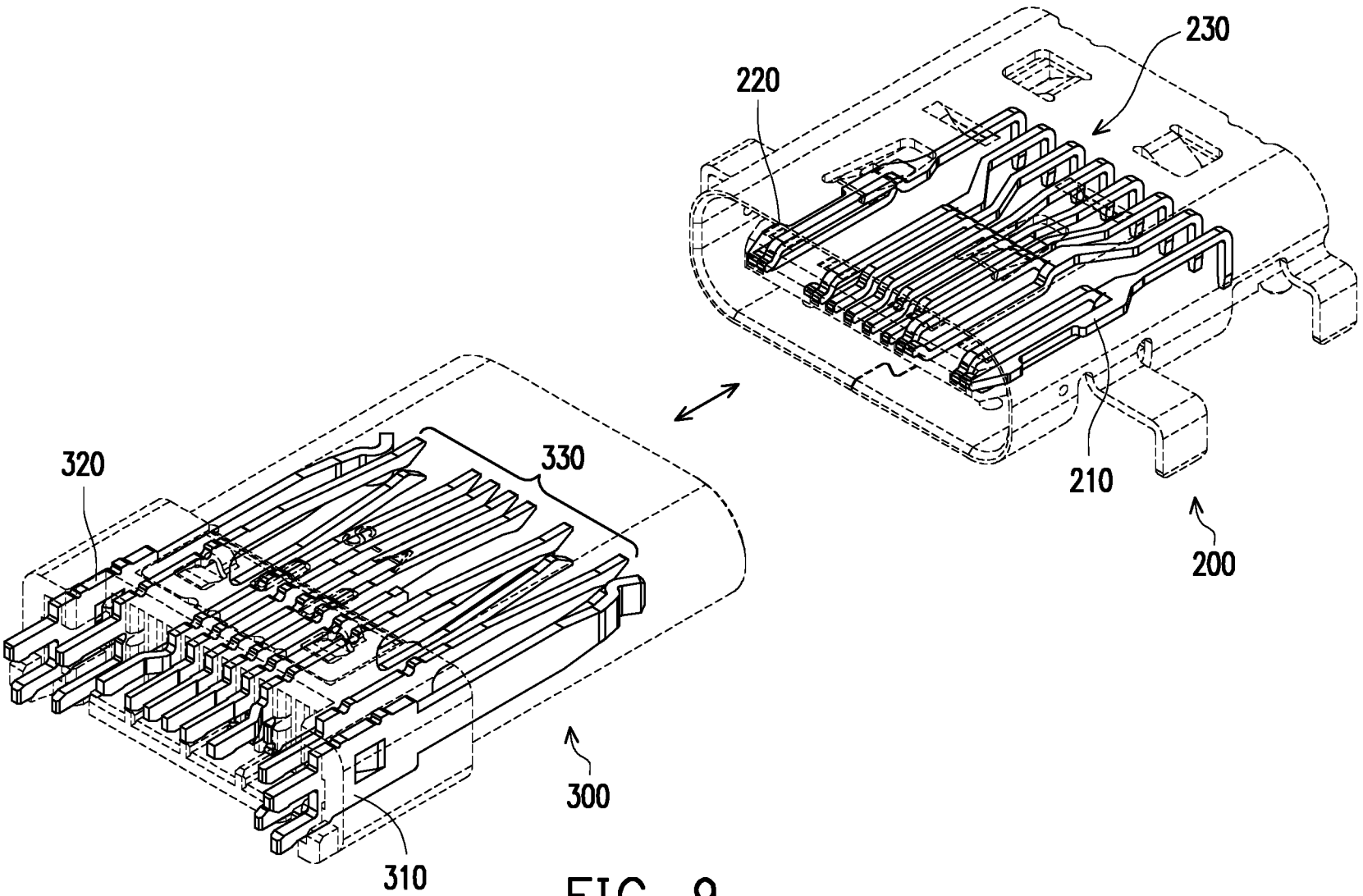
FIG. 9 illustrates a schematic view of an electrical connector according to another embodiment of the invention.
Figure 10:
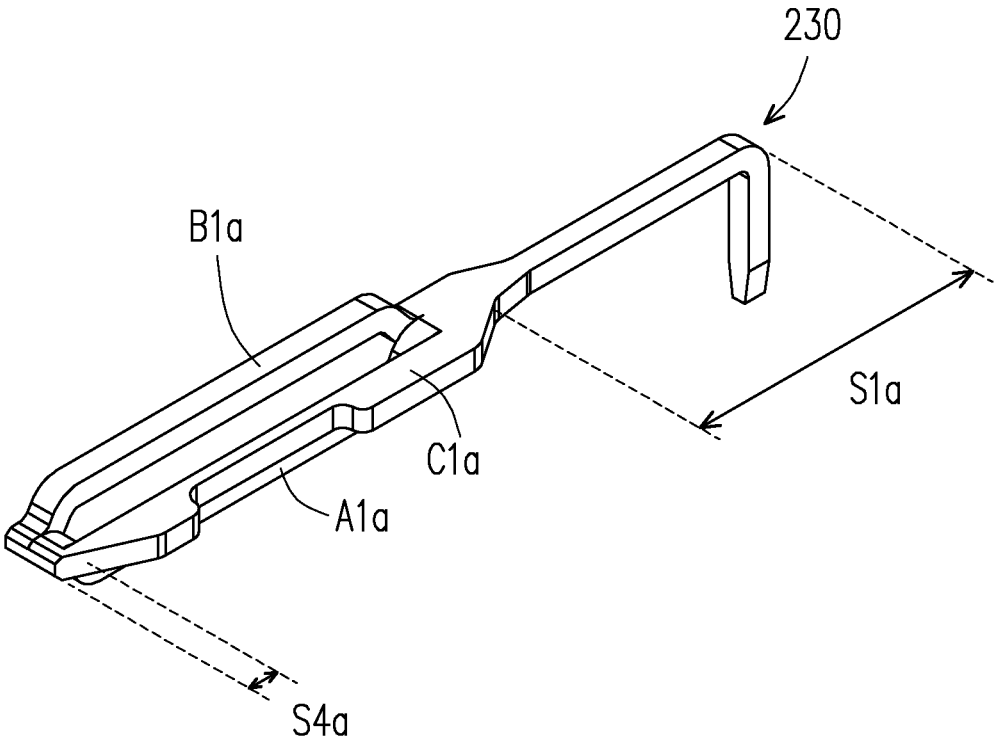
FIGS. 10 is a partial schematic view of the electrical connector of FIG. 9.

FIG. 9 illustrates a schematic view of an electrical connector according to another embodiment of the invention. FIGS. 10 is a partial schematic view of the electrical connector of FIG. 9. Referring to FIGS. 9 and 10, the non-terminal components are shown as dash lines, so as to clearly identify the profiles of the terminals. In this embodiment, an electrical connector 200 is an electrical receptacle connector, for example, and has a plurality of terminals 230. In addition, a part (ground) of the terminal and the grounding member form integrally-molded structures 210 and 220. An electrical connector 300 is an electrical plug connector, for example, and includes terminals 330 and a pair of grounding side latches 310 and 320 arranged on opposite lateral sides of the terminals 330. When the electrical connectors 200 and 300 are mated to each other, in addition to the terminals 230 and 330 being correspondingly pressed against each other, the grounding side latches 310 and 320 are respectively buckled to the integrally-molded structures 210 and 220 to provide proper mechanical and electrical mating of the plug connector to the electrical receptacle connector, so as to make ground connections and thus to provide a ground path during insertion of the electrical plug connector to the electrical receptacle connector.

Referring to FIG. 10, here, the integrally-molded structure 210 is described as an example (the integrally-molded structure 220 is the same, so the descriptions will not be repeated). The integrally-molded structure 210 is essentially formed by two grounding terminals and a grounding member, and sequentially includes, along the extending direction of the integrally-molded structure 210, a first section S1*a*, a second section C1*a* having a bifurcation, a third section A1*a* and a fourth section B1*a*, and a fifth section S4*a* where the structures converge into one again. The second section C1*a* is comparable to the grounding member C1 of the foregoing embodiment, the third section A1*a* is comparable to the terminal A1 of the foregoing embodiment, and the fourth section B1*a* is comparable to the terminal B1 of the foregoing embodiment. Thus, it may be clearly seen when the terminals of the embodiment are classified into the first terminal set 121 and the second terminal set 122 like in the foregoing embodiment, a pair of grounding terminals (terminals A1 and B1) from the first terminal set 121 and the second terminal set 122 on the same side and the grounding member (the grounding member C1) also on the same side form an integrally-molded structure in this embodiment. Here, the first section S1*a* and the second section C1*a* are located on the same plane, the third section A1*a* has a descending profile with respect to the first section S1*a* and the second section C1*a*, the fourth section B1*a* has an ascending profile with respect to the first section S1*a* and the second section C1*a*, and eventually the second section C1*a*, the third section A1*a*, and the fourth section B1*a* converge again to form a fifth section S4*a* coplanar with the first section S1*a* and the second section C1*a*. The fifth section S4*a* is comparable to the fourth section S4 of the foregoing embodiment.

In view of the foregoing, in the electrical connector according to the invention, at least one grounding terminal and the grounding member next to the grounding terminal form an integrally-molded structure, and along the arrangement direction of the terminals, a portion of the grounding terminal and a portion of the grounding member are misaligned from each other. In other words, by integrally molding the grounding terminal and the grounding member structure, the manufacturing process may be effectively simplified. In other words, the grounding terminal and the grounding member may be manufactured by using a single mold set. Therefore, the manufacturing cost may be effectively reduced. Meanwhile, the portions where the grounding member and the grounding terminals are misaligned from each other are also the portions exposed from the insulating body, i.e., the portions being electrically pressed when the electrical connector is mated with another electrical connector. Therefore, the pitch between terminals defined in relevant standards of the electrical connector is still met. Accordingly, the electrical connector according to the invention exhibits desirable effects in design and manufacture under the premise that the required functional conditions are met.

It will be apparent to those skilled in the art that various modifications and variations may be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electrical connector, comprising:

an insulating body comprising a tongue, wherein the tongue has a side recess on a lateral side of the tongue;

a plurality of terminals disposed in the insulating body; and at least one grounding member disposed inside the lateral side of the tongue and partially exposed on the side recess of the tongue, wherein at least one grounding terminal among the terminals and the at least one grounding member next to the grounding terminal form an integrally-molded structure, and a portion of the at least one grounding terminal and a portion of the at least one grounding member are misaligned from each other in an arrangement direction of the terminals.

2. The electrical connector as claimed in claim 1, wherein the integrally-molded structure has a first section, a second section, and a third section, the second section and the third section extend bifurcate from the first section, the second section is the portion of the at least one grounding terminal, and the third section is the portion of the at least one grounding member.

3. The electrical connector as claimed in claim 2, wherein the first section and the second section are located on a same plane, and the third section is located above the plane.

4. The electrical connector as claimed in claim 2, wherein the integrally-molded structure further comprises a fourth section, and the second section and the third section are respectively connected between the first section and the fourth section.

5. The electrical connector as claimed in claim 4, wherein the fourth section and the third section are located on a same plane.

6. The electrical connector as claimed in claim 2, wherein the integrally-molded structure has a bending part located between the first section and the third section, and a side surface of the insulating body has at least one protruding block. pressed against the bending part.

7. The electrical connector as claimed in claim 1, wherein the terminals are classified into a first terminal set and a second terminal set, the first terminal set is located on a first plane of the insulating body, the second terminal set is located on a second plane of the insulating body, the first plane is parallel to and different from the second plane, and the at least one grounding member and a grounding terminal of the first terminal set form the integrally-molded structure, or the at least one grounding member and a grounding terminal of the second terminal set form the integrally-molded structure.

8. The electrical connector as claimed in claim 7, wherein the portion of the at least one grounding member misaligned from the portion of the at least one grounding terminal is located on a third plane of the insulating body, the third plane is parallel to and different from the first plane and the second plane, and the third plane is located between the first plane and the second plane.

9. The electrical connector as claimed in claim 7, wherein an orthogonal projection of the grounding terminal of the first terminal set on the second plane is overlapped with the grounding terminal of the second terminal set, and an orthogonal projection of the at least one grounding member on the second plane is misaligned from and not overlapped with the grounding terminal of the second terminal set.

10. The electrical connector as claimed in claim 1, wherein the terminals are classified into a first terminal set and a second terminal set, the first terminal set and the second terminal set are located on different planes of the insulating body, each of the first terminal set and the second tenninal set has a grounding terminal, and the grounding terminals are located at a same side of the insulating body and form the integrally-molded structure with the grounding member.

11. An electrical connector, comprising:

an insulating body comprising a tongue, wherein the tongue has two side recesses on opposite lateral sides of the tongue;

a plurality of terminals disposed on an upper surface and a lower surface of the tongue; and a pair of grounding members disposed inside the opposite lateral sides of the tongue and partially exposed on the opposite side recesses of the tongue, wherein one grounding terminal is among the terminals and the corresponding grounding member next to the grounding terminal form an integrally-molded structure.

12. The electrical connector as claimed in claim 11, wherein a portion of the grounding terminal and a portion of the corresponding grounding member are misaligned from each other in an arrangement direction of the terminals.

13. The electrical connector as claimed in claim 12, wherein the integrally-molded structure has a first section, a second section, and a third section, the second section and the third section extend bifurcate from the first section, the second section is the portion of the grounding terminal, and the third section is the portion of the corresponding grounding member.

14. The electrical connector as claimed in claim 11, wherein the pair of grounding members are partially protruded slightly beyond the corresponding side recesses of the tongue.

15. An electrical connector, comprising:

an insulating body comprising a tongue;

a plurality of terminals disposed on an upper surface and a lower surface of the tongue; and a pair of grounding members disposed inside the opposite lateral sides of the tongue and partially exposed on the opposite lateral side surfaces of the tongue, wherein one grounding terminal among the terminals and the corresponding grounding member next to the grounding terminal form an integrally-molded structure.

16. The electrical connector as claimed in claim 15, wherein a portion of the grounding terminal and a portion of the at least one grounding member are misaligned from each other in an arrangement direction of the terminals.

17. The electrical connector as claimed in claim 16, wherein the integrally-molded structure has a first section, a second section, and a third section, the second section and the third section extend bifurcate from the first section, the second section is the portion of the grounding terminal, and the third section is the portion of the corresponding grounding member.

18. The electrical connector as claimed in claim 15, wherein the pair of grounding members are partially protruded slightly beyond the corresponding lateral side surfaces of the tongue.

* * * * *